US005435063A

United States Patent [19]

Russo

[11] Patent Number: 5,435,063

[45] Date of Patent: Jul. 25, 1995

[54] STEEL ICE CHOPPER

[76] Inventor: Luciano Russo, 2113 E. 74th St., Brooklyn, N.Y. 11234

[21] Appl. No.: 192,330

[22] Filed: Feb. 4, 1994

[51] Int. Cl.[6] ..... F25C 5/16

[52] U.S. Cl. ..... 30/164.5; 30/344

[58] Field of Search ..... 30/164.5, 164.6, 164.7, 30/164.8, 340, 344, 366; 7/158; 294/49, 61; 16/110 R

[56] References Cited

U.S. PATENT DOCUMENTS 1,012,088 12/1911 Lee ..... 30/344

2,570,732 10/1951 Taylor ..... 30/164.5

4,862,591 9/1989 Barringer ..... 30/164.8

*Primary Examiner*—Richard K. Seidel

*Attorney, Agent, or Firm*—Darby & Darby

[57] ABSTRACT

An elongated member has a first axial end and a second axial end. The first axial end has a device for gripping the elongated member. The second axial end has a recessed slot. A blade member is fixedly connected to the second axial end of the elongated member. The blade member has a first side and a second opposite side. A portion of the first side of the blade member is disposed within the slot of the elongated member. The second end of the blade member is a free end having a sharp angled edge.

12 Claims, 1 Drawing Sheet

STEEL ICE CHOPPER

FIELD OF THE INVENTION

The present invention relates generally to ice choppers. More specifically, the present invention relates to an ice chopper which has a steel blade member welded to a steel tubular member.

BACKGROUND OF THE INVENTION

Ice choppers have been known for years. Conventional ice choppers include a cylindrical handle typically made of solid wood and a metal blade. A hollow cylindrical mounting flange extends from the side of the blade opposite to the free or chopping end and is used to connect the blade member to the wooden handle. The handle is usually fixed in place in the mounting flange by a press fit or by the use of a screw penetrating through the cylindrical flange and into the wood. A considerable amount of force is required to chop down and break the ice on the surface below. However, because conventional designs do not include a secure and stable mounting of the blade member of the ice pick with respect to the wooden handle member, a satisfactory chopping of the ice on the desired surface is usually not accomplished. In addition, the blade member frequently breaks free from the mounting flange rendering the ice chopper useless.

It is, therefore, an object of the present invention to provide an ice chopper that permits the use of the ice choppers own weight to swing the ice chopper down while also relying on a strong and stable connection between the elongated tubular member and the blade member to aid in chopping the ice.

It is an object of the present invention to provide an ice chopper that requires less parts, and thus is smaller and easier to manufacture. It is still a further object of the present invention that the ice chopper be simple and cost effective to manufacture, yet reliable and efficient in use.

SUMMARY OF THE INVENTION

In accordance with a preferred embodiment demonstrating objects, features and advantages of the invention, an ice chopper includes an elongated member having a first axial and a second axial end. The first axial end has a device for gripping the elongated member. The second axial end has a recessed slot. A blade member is fixedly connected to the second axial end of the elongated member. The blade member has a first side and a second opposite side. A portion of the first side of the blade member is disposed within the slot of the elongated member. The second end of the blade member is a free end having a sharp angled edge.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EMBODIMENTS

Figure 1:
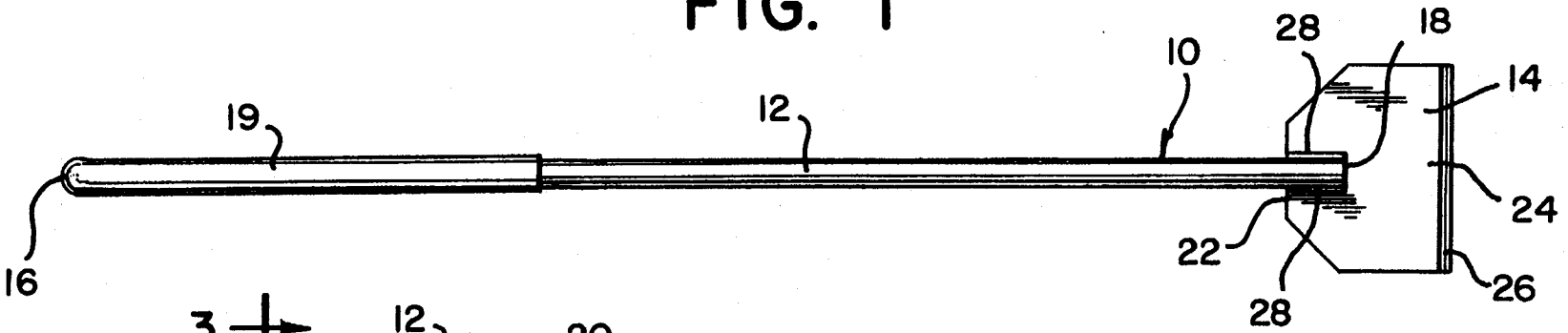
FIG. 1 is a plan view of an ice chopper according to the present invention.

Referring now to FIG. 1 an ice pick or chopper 10 according to the present invention is illustrated. Ice chopper 10 comprises an elongated tubular member 12 and a blade member 14.

The elongated tubular member 12 has a first axial end 16 and a second axial end 18 adjacent to the first axial end. A gripping portion 19 of the tubular member 12 is disposed. The gripping portion can include a roughened outer surface of the tubular member 12, or a rubber or leather grip section, or a smooth continuation of the tubular member 12. In addition, it is preferred that a rubber cap (not shown) be placed on the first axial end 16 of the tubular member 12. The cap should be sized to fit comfortably in the palm of the user's hand.

Figure 2:
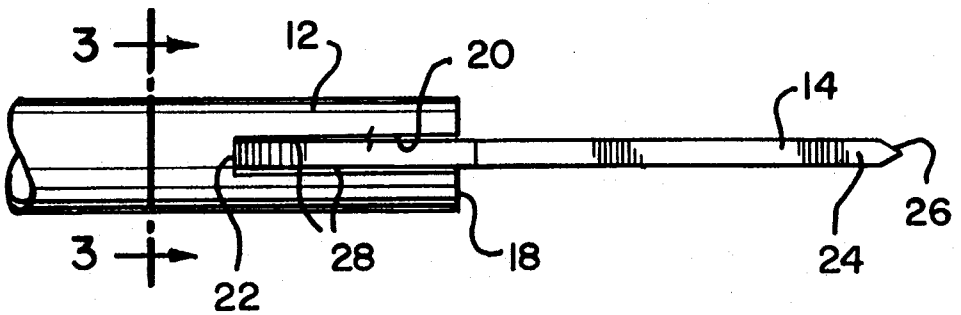
FIG. 2 is a partial side view of the blade member of FIG. 1.
Figure 3:
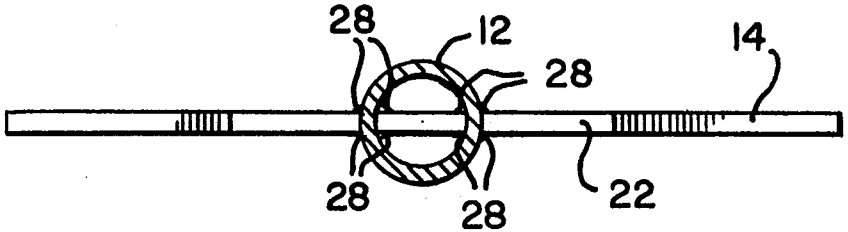
FIG. 3 is a sectional view taken along lines 3—3 of FIG. 2 and looking in the direction of the arrows.

As illustrated in FIG. 2, the second axial end 18 of the tubular member 12 includes a U-shaped recessed slot 20. The blade member 14 is fixedly connected to the second axial end 18 of the elongated member 12. Blade member 14 has a first side 22 and a second opposite side 24. A portion of the first side 22 of the blade member 14 is disposed within the U-shaped recess slot 20 of the elongated member 12. The second end 24 of the blade member constitutes a free end and has a sharp angled edge 26. The blade member 14 is welded to the tubular member 12 with preferably a full penetration weld 28. The use of a full penetration weld 28 is important because it provides relatively high strength and stability to the blade member 14 when in use. Additionally, the inner cylindrical surface of tubular member 12 may be welded to the blade member 14 as illustrated in FIG. 3. The full penetration weld 28 connects the inner surface of the elongated member 12 to the blade member 14 and the outer surface of the elongated member 12 to the blade member.

The sharp angle edge 26 preferably forms an acute angle $\alpha$ that is less than 90 degrees. In one preferred embodiment the angle $\alpha$ is 60 degrees. In other preferred embodiments the angle $\alpha$ can be 45 degrees, 30 degrees or 20 degrees.

Blade member 14 and elongated member 12 are each preferably made of steel. It is preferred that the blade member 14 be made of a solid material and that the tubular member 12 be hollow. Of course, tubular member 12 can take other shapes such as a square, octagon, rectangle, etc. In addition, the handle portion 19 of the tubular member can include a conventional handle as are used with snow shovels.

The use of the ice chopper 10 will be described with reference to FIGS. 1–3. The ice chopper 10 of the present invention typically weighs between six and seven pounds, which is considerably heavier than conventional ice choppers. The present inventor has found that an ice chopper of this weight can be lifted one to two feet off the ground by most users without requiring strenuous effort. In use, the ice chopper is lifted off the ground by one to two feet and the user can simply drop and guide the ice chopper onto the ice or exert minimal force to bring the blade's sharp angled edge into contact with the ice. Using either method will result in a superior chopping of ice when compared to using conventional ice choppers because the momentum created by the weight of the ice chopper is significantly greater using the present invention than the momentum created with a conventional ice chopper even when the user exerts considerable force.

It will be appreciated that the ice chopper 10 of the present invention successfully permits the chopping of ice on surfaces without the need for the user to use excessive force to move the chopper downward or in the direction of the ice. Because the metal blade is positioned in a recessed slot of the metal tubular member 12 and is connected to the tubular member with a full penetration weld, the ice chopper 10 is significantly stronger than conventional ice choppers. In addition, the angled edge 26 of the free end of the blade member also contributes to the significant and improved ice chopping ability of the present invention.

Having described the presently preferred exemplary embodiments of a new and improved ice chopper, in accordance with the present invention, it is believed that other modifications, variations and changes will be suggested to those skilled in the art in view the teachings set forth herein. It is therefore, to be understood that all such variations, modifications and changes are believed to fall within the scope of the present invention as defined by the appended claims.

What is claimed is:

1. An ice chopper comprising:

an elongated member having a first axial end and a second axial end, said elongated member being hollow and having an inner surface and an outer surface, said first axial end having means for gripping said elongated member, said second axial end having a recessed slot;

a blade member being fixedly connected to said second axial end of said elongated member, said blade member having a first side and a second opposite side, a portion of said first side of said blade member being disposed within said slot of said elongated member, said second side of said blade member being a free end and having a sharp angled edge, said blade member being welded to said elongated member with a full penetration weld, said full penetration weld connecting said inner surface of said elongated member to said blade member and said outer surface of said elongated member to said blade member.

2. The ice copper of claim 1, wherein said elongated member has a cylindrical shape in cross-section.

3. The ice chopper of claim 2, wherein said slot is U-shaped.

4. The ice chopper of claim 3, wherein said sharp angled edge has an acute angle of less than 90°.

5. The ice chopper of claim 4, wherein said sharp angled edge has an acute angle of about 60°.

6. The ice chopper of claim 4, wherein said sharp angled edge has an acute angle of at most 60°.

7. The ice chopper of claim 6, wherein said sharp angled edge has an acute angle of at most 45°.

8. The ice chopper of claim 7, wherein said sharp angled edge has an acute angle of at most 30°.

9. The ice chopper of claim 6, wherein said blade member is made of steel.

10. The ice chopper of claim 9, wherein said elongated blade member is made of steel.

11. The ice chopper of claim 10, wherein said ice chopper weighs between six and seven pounds.

12. The ice chopper of claim 1, wherein said portion of said blade member is disposed radially within said hollow elongated member.

* * * * *